US006436017B1

(12) United States Patent
Chen

(10) Patent No.: US 6,436,017 B1
(45) Date of Patent: Aug. 20, 2002

(54) MULTI-FUNCTION PERSONAL EXERCISER

(76) Inventor: Chih-Liang Chen, No. 10, Lane 1431, Kuanghsing Rd., Pateh City, Taoyuan Hsien (TW)

( * ) Notice: Subject to any disclaimer, the term of this patent is extended or adjusted under 35 U.S.C. 154(b) by 0 days.

(21) Appl. No.: 09/742,418

(22) Filed: Dec. 22, 2000

(51) Int. Cl.[7] ..... A63B 21/02

(52) U.S. Cl. ..... 482/121; 482/44; 482/907; 482/126

(58) Field of Search ..... 482/121–133, 482/140, 142, 148, 95–97, 44, 100, 103, 79–80, 139, 907, 908

(56) References Cited

U.S. PATENT DOCUMENTS 3,759,512 A * 9/1973 Yount et al. ..... 482/62
5,993,361 A * 11/1999 Paoli et al. ..... 482/121
6,024,679 A * 2/2000 Castallanos et al. ..... 482/140

* cited by examiner

*Primary Examiner*—Michael A. Brown
*Assistant Examiner*—Lori Baker Amerson

(57) ABSTRACT

A personal exerciser has a back plate, two connecting plates, at least one elastic member and two lateral arms. Each connecting plate is pivotally connected to opposite sides of the back plate. Each elastic member is connected between the two connecting plates. Each lateral arm is attached to each connecting plate, and the angle of the lateral arm is adjustable relative to the back plate. With such a personal exerciser, the elastic members will be stretched while at least one of the arms is pivoted relative to the back plate. An exercising or conditioning effect can be provided. In addition, because the angle between the back plate and each lateral arm is adjustable, the exerciser can be used in different ways. The use of the exerciser becomes more versatile.

13 Claims, 6 Drawing Sheets

MULTI-FUNCTION PERSONAL EXERCISER

BACKGROUND OF THE INVENTION

1. Field of the Invention

The present invention relates to an exerciser, and more particularly to a personal exerciser with multiple functions.

2. Description of Related Art

Personal exercisers are used in houses to exercise or condition a user's body. However, conventional personal exercisers have a simple structure and just one function. Conventional personal exercises are not versatile and have limited use.

To overcome the shortcomings, the present invention provides a multi-function personal exerciser to mitigate or obviate the aforementioned problems.

SUMMARY OF THE INVENTION

The main objective of the invention is to provide a personal exerciser that is adjustable and has multiple functions. The exerciser has a back plate, two connecting plates, at least one elastic member and two lateral arms. The connecting plates are pivotally connected to opposite edges of the back plate. Each elastic member is connected between the two connecting plates. A lateral arm is attached to each connecting plate, and the angle of the lateral arm is adjustable relative to the back plate. Consequently, the elastic members will be stretched when at least one of the arms is pivotally rotated relative to the back plate. An exercising effect can be achieved. Because the angle between the back plate and each lateral arm is adjustable, the use of the exerciser becomes more versatile.

Other objects, advantages and novel features of the invention will become more apparent from the following detailed description when taken in conjunction with the accompanying drawings.

DETAILED DESCRIPTION OF PREFERRED EMBODIMENT

Figure 1:
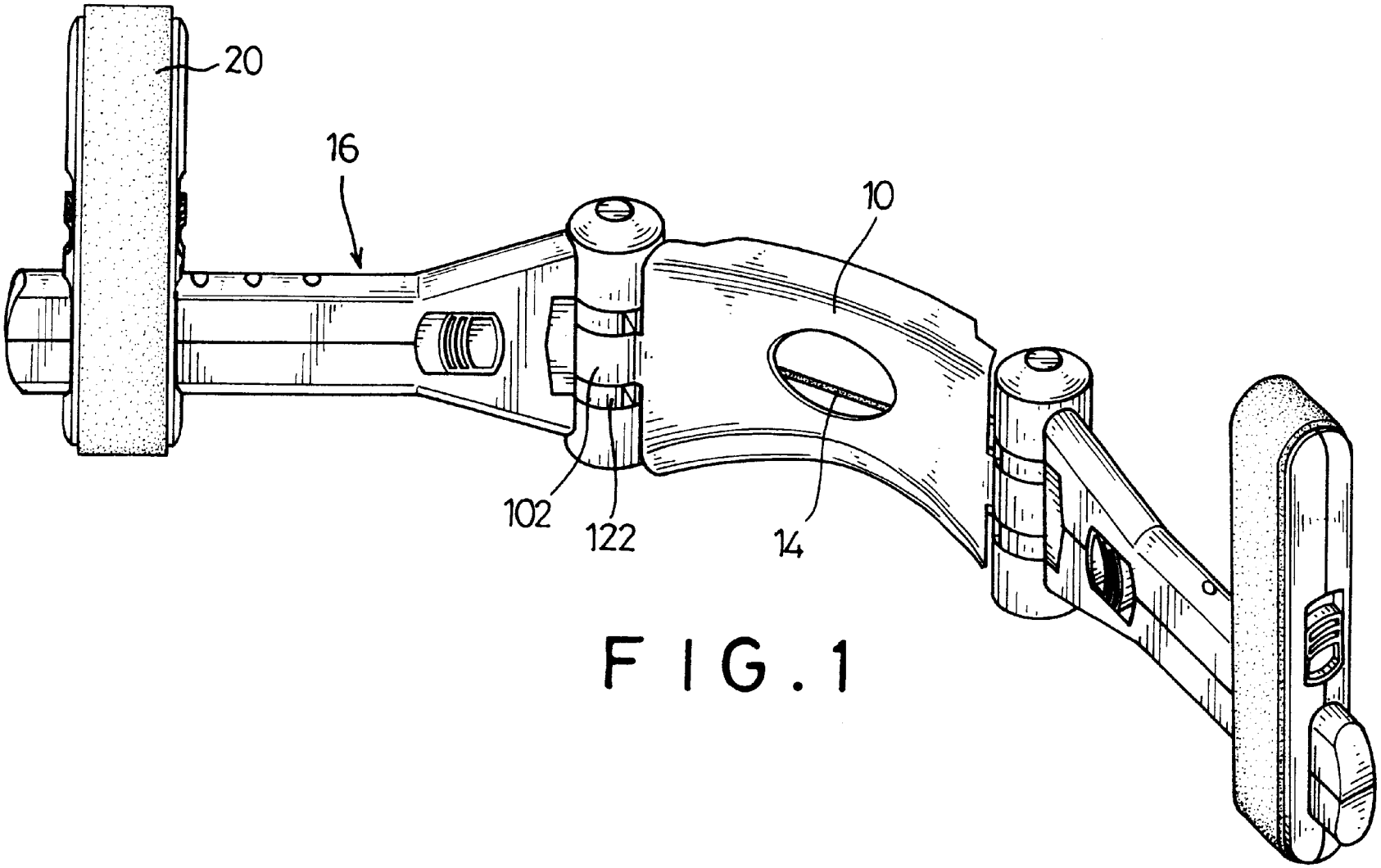
FIG. 1 is a perspective view of a personal exerciser in accordance with the present invention.
Figure 2:
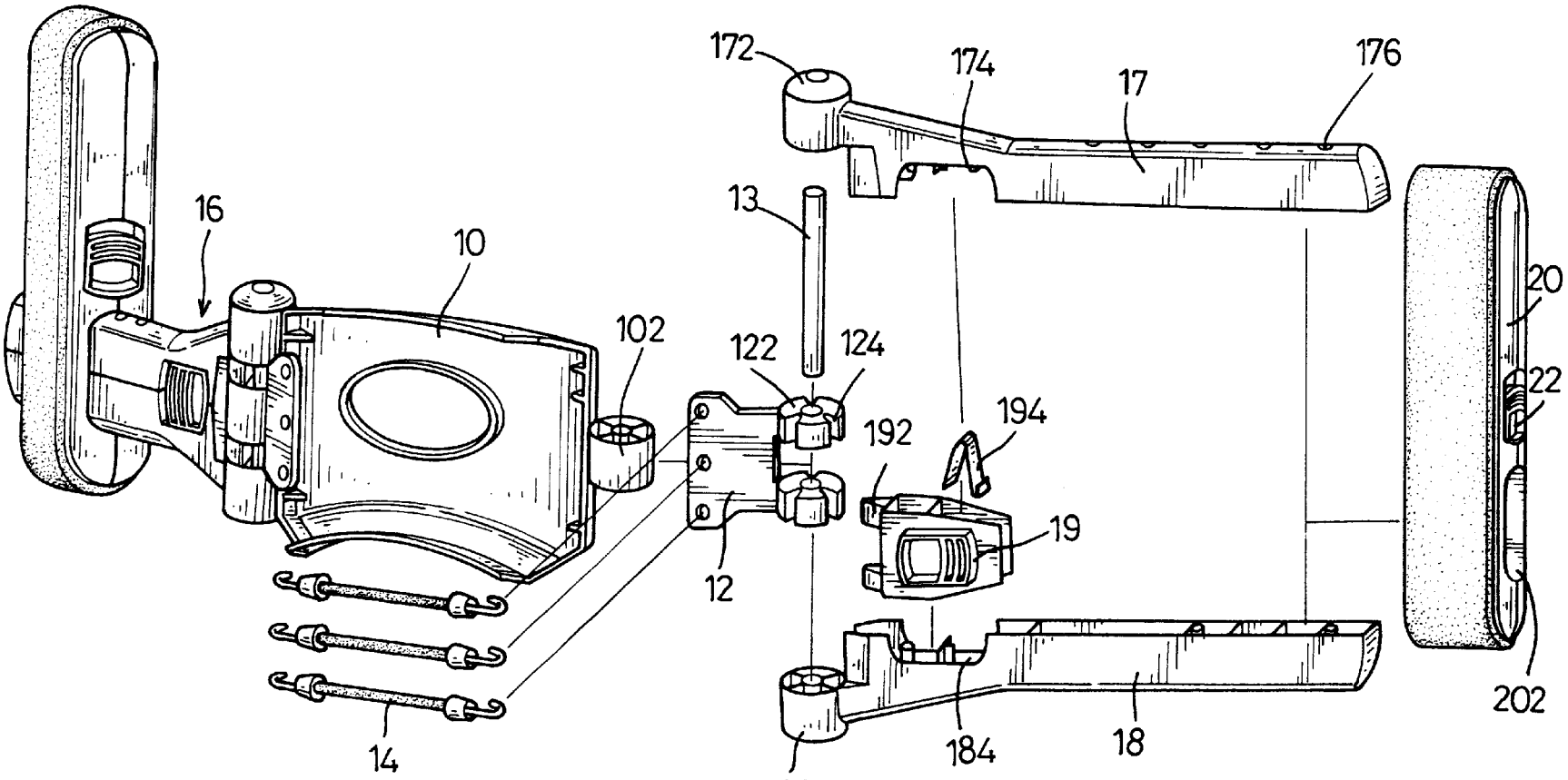
FIG. 2 is an exploded perspective view of the exerciser in FIG. 1.

With reference to FIGS. 1 and 2, a personal exerciser in accordance with the present invention comprises a back plate (10), two connecting plates (12), at least one elastic member (14) and two lateral arms (16). The back plate (10) is curved. A hinge (102) is formed on each side of the back plate (10). Two blocks (122) are separately formed on one edge of each connecting plate (12). Each hinge (102) fits between the blocks (122) of the corresponding connecting plate (12). A pivot pin (13) simultaneously extends through the blocks (122) of each connecting plate (12) and the corresponding hinge (102) on the back plate (10), such that the connecting plates (12) pivotally connected to opposite sides of the back plate (10) with the pivot pin (13). Each elastic member (14) is connected between the connecting plates (12) at the edge opposite to the blocks (122).

A lateral arm (16) is attached to each connecting plate (12). Each lateral arm (16) is composed of an upper body (17) and a lower body (18). An upper cap (172) is formed on one end of the upper body (17), and a lower cap (182) is formed on the corresponding end of the lower body (18). Opposite ends of the pivot pin (13) are respectively received in the upper cap (172) and lower cap (182) so that each lateral arm (16) is co-axially attached to the corresponding connecting plate (12). Multiple recesses (124) are defined around the periphery of each block (12). A sliding lock (19) is slidably received between the upper body (17) and the lower body (18). A cavity (174,184) is defined in each of the upper body (17) and the lower body (18) to receive the sliding lock (19). A tooth (192) is formed on the sliding lock (19) and corresponds to each block (122) of the corresponding connecting plate (12). A biasing member (194) is mounted between the lateral arm (16) and the sliding lock (19) to provide a biasing force on the sliding lock (19), such that each tooth (192) on the sliding lock (19) will engage one of the recesses (124) on the corresponding block (122) when the sliding lock (19) is released. Accordingly, each lateral arm (16) is securely attached to the corresponding connecting plate (12) at a predetermined angle.

Figure 3:
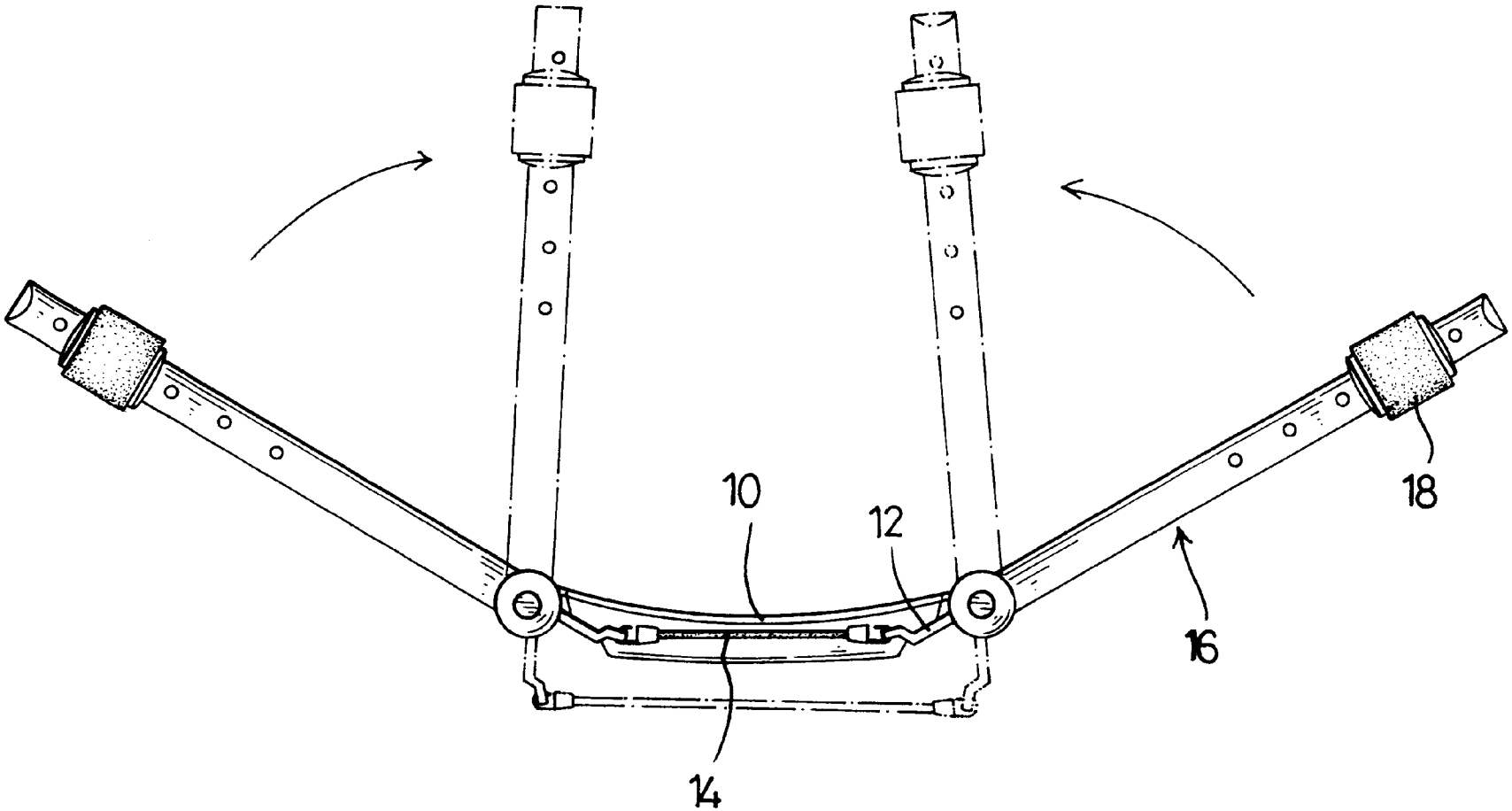
FIG. 3 is an operational top plan view of the exerciser in FIG. 1.

With reference to FIGS. 1 to 3, a user can place the back plate (10) against his or her head, back, chest, abdomen or buttocks. His or her two hands respectively hold the two lateral arms (16). When any one of the lateral arms (16) is pivoted relative to the back plate (10) by the user, the corresponding connecting plate (12) will pivot with the lateral arm (16) relative to the other connecting plate (10). The elastic members (14) will be stretched and provide a resistance against the user. Consequently, an exercising or a conditioning effect is achieved by the user.

Figure 4:
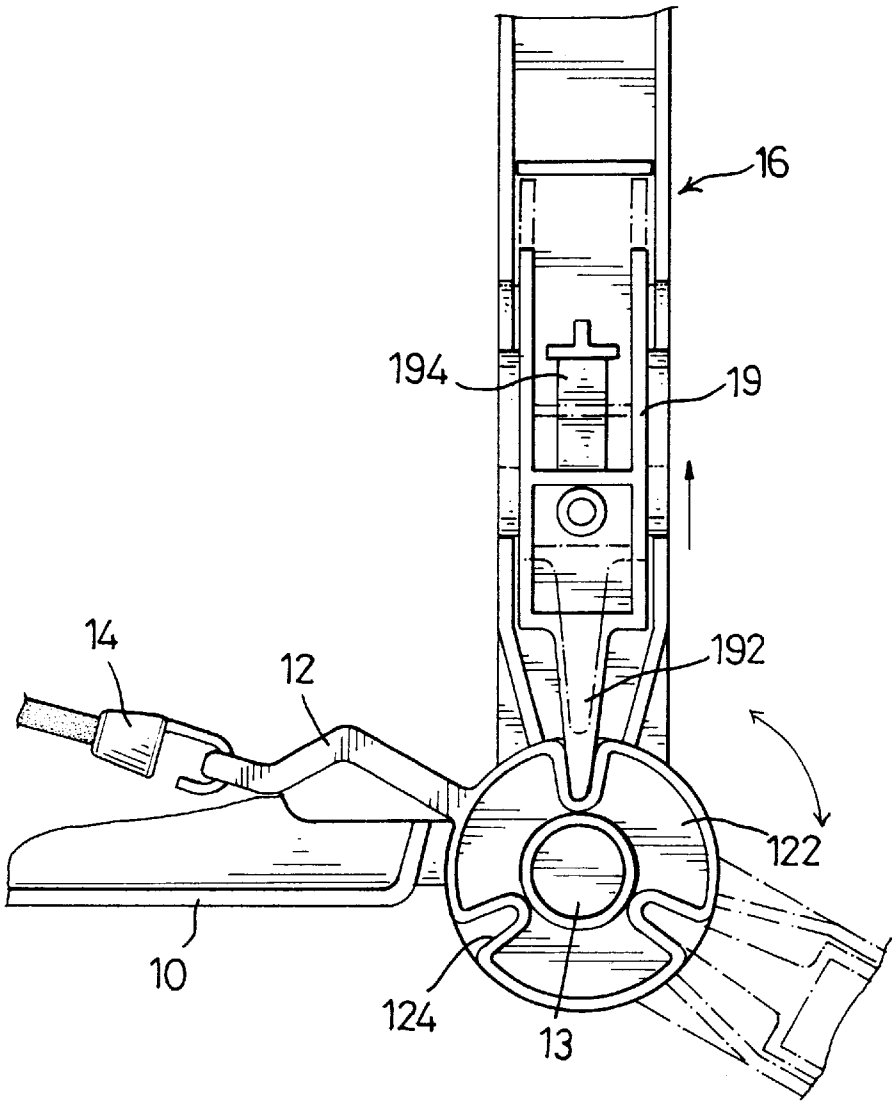
FIG. 4 is an enlarged top plan view of the joint between the back plate and the lateral arm of the exerciser in FIG. 1 showing the lateral arm adjusted to different angles relative to the back plate.
Figure 5:
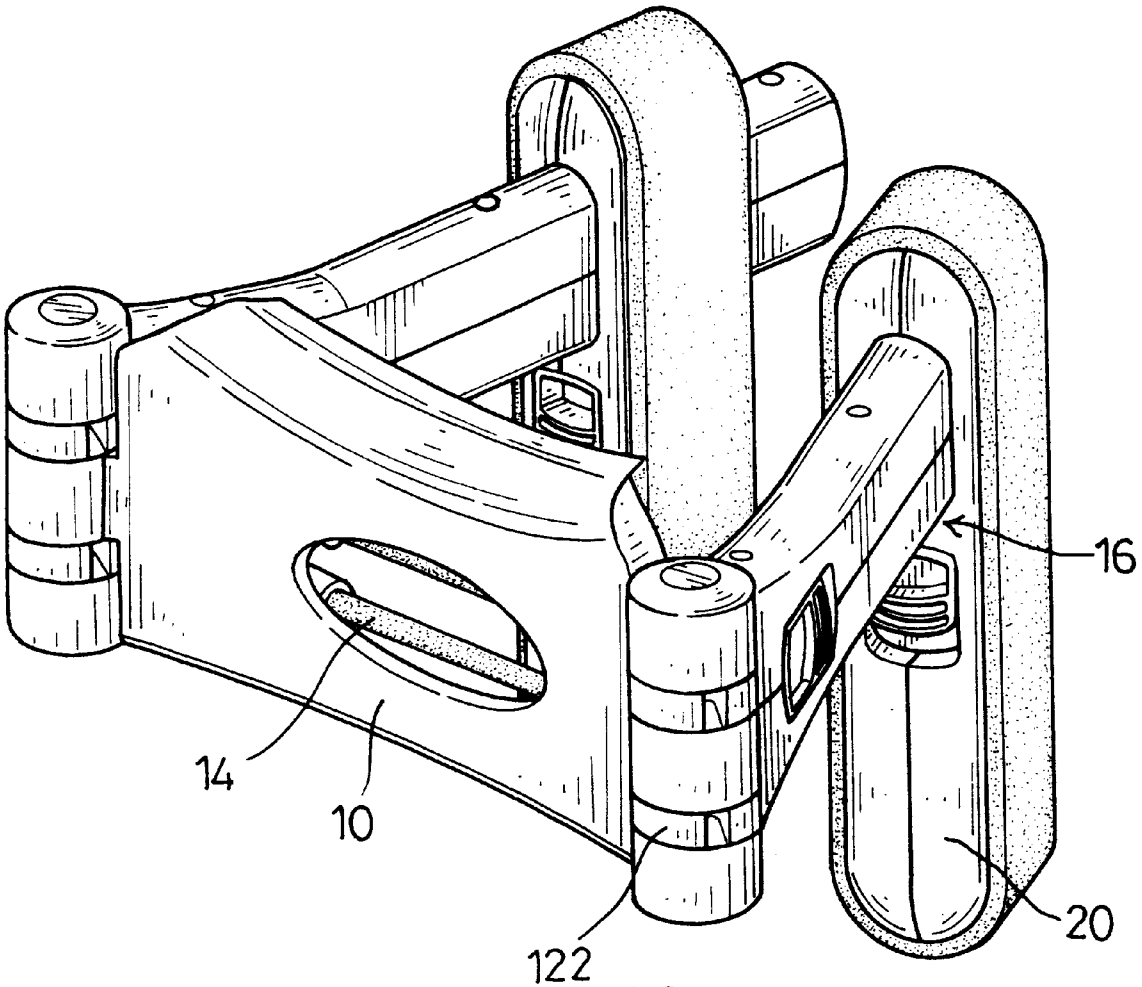
FIG. 5 is a perspective view the personal exerciser in accordance with the present invention in another rest configuration.
Figure 6:
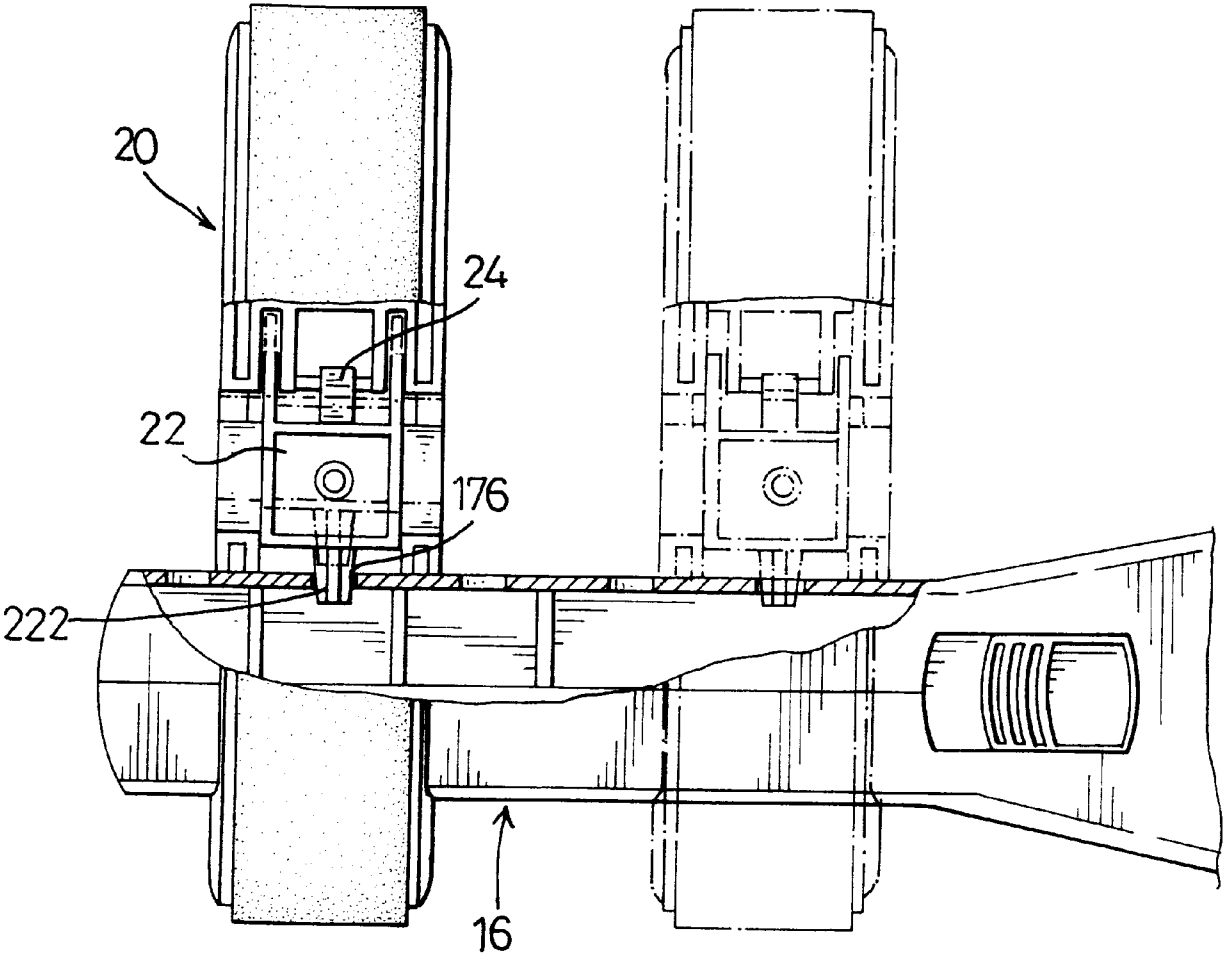
FIG. 6 is a side plan view in partial section of the lateral arm of the exerciser in FIG. 1 showing that the vertical arm slides along the lateral arm to adjust the location on the lateral arm.

With reference to FIGS. 2 and 4, when the user pushes the sliding lock (19) to disengage the tooth (192) from the recess (122) on the corresponding block (122), the lateral arm (16) can rotate relative to the connecting plate (12). When the lateral arm (16) rotates to a position where the tooth (192) faces another recess (124), the biasing member (194) will push the sliding lock (19), and the tooth (192) will engage the new recess (124) when the user releases the sliding lock (19). Consequently, the lateral arm (16) will be positioned at a new angle relative to the back plate (10) as shown in FIG. 5. The user can rotate the lateral arms (16) relative to the back plate (10) with his or her hands or legs. Therefore, the original angle between the back plate (10) and each lateral arm (16) is not only adjustable, but the personal exerciser is also changeable. The the personal exerciser becomes more versatile.

With reference to FIGS. 1, 2, 5 and 6, a vertical arm (20) is slidably mounted on each lateral arm (16). A through hole (202) corresponding to the shape of the lateral arm (16) is defined through each vertical arm (20) to mount the vertical arms (20) on the corresponding lateral arm (16) by sliding the through hole (202) onto the lateral arm (16). Multiple bores (176) are defined in either the upper body (17) or the lower body (18) of the lateral arm (16) along a longitudinal axial line of the lateral arm (16). A vertical arm lock (22) is slidably mounted in each vertical arm (20). A locking post (222) is formed on the vertical arm lock (22) and faces the bores (176) on the lateral arm (16). A biasing member (24) is mounted between the vertical arm (20) and the vertical arm lock (22) to provide a biasing force on the vertical arm lock (22). The locking post (222) on the vertical arm lock (22) engages the facing bore (176) by means of the biasing force of the biasing member (24). Consequently, the vertical arm (20) is adjustably mounted on the lateral arm (16) at predetermined positions. With such a vertical arm (20), the user can hold the vertical arm (20) to pivot the lateral arm (16). The operation of the exerciser becomes easier.

When the user pushes the vertical arm lock (22) on the vertical arm (20), the locking post (222) will release from the bore (176) and the vertical arm (20) can slide along the lateral arm (16). When the vertical arm (20) moves to a position where the locking post (222) faces another bore (176). The biasing member (24) will push the vertical arm lock (22), and the locking post (222) will engage the new bore (176) when the user releases the vertical arm lock (22). Consequently, the vertical arm (20) will be fixed in a new position relative to the lateral arm (16) to meet the needs of different users.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A personal exerciser comprising:

a back plate having a hinge provided at each of two opposite sides of the back plate;

two connecting plates respectively and pivotally connected to the opposite sides of the plate;

at least one elastic member connected between the two connecting plates;

at least one block formed on one edge of each connecting plate and aligned with a respective one of the hinges of the back plate;

a pivot pin simultaneously extending through the at least one block of each connecting plate and the corresponding hinge on the back plate; and, a lateral arm adjustably attached to a free edge of each connecting plate.

2. The personal exerciser as claimed in claim 1, wherein each lateral arm is composed of an upper body and a lower body.

3. The personal exerciser as claimed in claim 2, wherein an upper cap is formed on one end of the upper body;

a lower cap is formed on one end of the lower body and corresponds to the upper cap; and two distal ends of the pivot pin are respectively received in the upper cap and lower cap, thereby each lateral arm is co-axially attached to the corresponding connecting plate.

4. The personal exerciser as claimed in claim 3, wherein multiple recesses are defined around each of the at least one block;

a sliding lock is slidably received between the upper body and the lower body of each lateral arm;

a tooth is formed on each sliding lock to engage with one of the recesses of the at least one block to which the tooth faces; and a biasing member is mounted between each lateral arm and the sliding lock to provide a biasing force on the sliding lock.

5. The personal exerciser as claimed in claim 4, wherein a cavity is defined in each of the upper body and the lower body to receive the sliding lock.

6. The personal exerciser as claimed in claim 1, wherein two blocks are formed on each connecting plate to sandwich the corresponding hinge of the back plate between the blocks.

7. The personal exerciser as claimed in claim 6, wherein each lateral arm is composed of an upper body and a lower body.

8. The personal exerciser as claimed in claim 7, wherein an upper cap is formed on one end of the upper body;

a lower cap is formed on one end of the lower body and corresponds to the upper cap; and two distal ends of the pivot pin are respectively received in the upper cap and lower cap, thereby each lateral arm is co-axially attached to the corresponding connecting plate.

9. The personal exerciser as claimed in claim 8, wherein multiple recesses are defined around each block;

a sliding lock is slidably received between the upper body and the lower body of each lateral arm;

a tooth is formed on each sliding lock to engage with one of the recesses of each block to which the tooth faces; and a biasing member is mounted between each lateral arm and the sliding lock to provide a biasing force on the sliding lock.

10. The personal exerciser as claimed in claim 9, wherein a cavity is defined in each of the upper body and the lower body to receive the sliding lock.

11. The personal exerciser as claimed in claim 1, further comprising a vertical arm slidably mounted on each lateral arm.

12. The personal exerciser as claimed in claim 11, wherein a through hole is defined through each vertical arm for the corresponding lateral arm to extend through the through hole.

13. The personal exerciser as claimed in claim 11, wherein multiple bores are defined in the lateral arm along a longitudinal axial line of the lateral arm;

a vertical arm lock is slidably mounted in each vertical arm;

a locking post is formed on the vertical arm lock to engage one of the bores on the lateral arm; and a biasing member is mounted between the vertical arm and the vertical arm lock to provide a biasing force on the vertical arm lock.

* * * * *